US007305201B2

(12) United States Patent
Kimura

(10) Patent No.: US 7,305,201 B2
(45) Date of Patent: Dec. 4, 2007

(54) IMAGE FORMING APPARATUS HAVING A COOLING STRUCTURE

(75) Inventor: Hisashi Kimura, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 158 days.

(21) Appl. No.: 11/228,236

(22) Filed: Sep. 19, 2005

(65) Prior Publication Data

US 2007/0065170 A1 Mar. 22, 2007

(51) Int. Cl.
*G03G 21/00* (2006.01)
*G03G 21/20* (2006.01)

(52) U.S. Cl. ..... 399/92; 399/93

(58) Field of Classification Search ..... 399/92, 399/93

See application file for complete search history.

(56) References Cited

U.S. PATENT DOCUMENTS 4,530,589 A * 7/1985 Adams ..... 399/92
4,695,151 A * 9/1987 Watanabe ..... 399/92
6,501,922 B2 * 12/2002 Ihara et al. ..... 399/92
2002/0186986 A1 * 12/2002 Makihira ..... 399/92

FOREIGN PATENT DOCUMENTS

JP 2000-047551 A * 2/2000
JP 2002-318513 A * 10/2002
JP 2003-140534 A 5/2003
JP 2003-316237 A 11/2003

* cited by examiner

*Primary Examiner*—Sophia S. Chen
(74) *Attorney, Agent, or Firm*—Foley & Lardner LLP

(57) ABSTRACT

An image forming apparatus includes a branch section that branches a cooling wind from a cooling fan into branched cooling winds and a wind guide path that guides the branched cooling winds branched by the branch section to cooling targets to be cooled, respectively, and exhausts the branched cooling winds. The wind guide path includes a first wind guide path that guides one of the branched cooling winds to a first cooling target at which a predetermined gas is mixed into the one of the branched cooling winds, and exhausts the one of the branched cooling winds and a second wind guide path that guides another one of the branched cooling winds to a second cooling target at which the predetermined gas is not mixed into another one of the branched cooling winds and exhausts another one of the branched cooling winds.

6 Claims, 7 Drawing Sheets

IMAGE FORMING APPARATUS HAVING A COOLING STRUCTURE

BACKGROUND OF THE INVENTION

1. Field of the Invention

The present invention relates to a cooling structure in an image forming apparatus.

2. Description of the Related Art

In an image forming apparatus, an image forming section requires a cooling process because heat is generated by operation of the image forming section which has electronic components including a power supply section to supply the apparatus with electric power, and a toner cartridge, a process unit, a laser unit, and the like to form an image on a sheet.

If there are plural heat generating portions (to be cooled), cooling fans may be provided so as to correspond respectively to these portions, thereby cooling these portions. In this structure, however, the number of cooling fans to be placed increases, undesirably from the viewpoint of space-saving and cost-reduction.

In recent years, a disclosure has hence been made of a technique of introducing a cooling wind blowing from one cooling fan to plural cooling targets to be cooled, thereby to cool efficiently the inside of the apparatus with an extremely reduced number of cooling fans placed (Jpn. Pat. Appln. Laid-Open Publications No. 2003-316237 and No. 2003-140534).

However, a kind of unit like a process unit which generates a predetermined air-pollutive gas such as ozone and another kind of unit like an electronic component which does not generate any gas are included, mixed in cooling targets in the image forming apparatus as described above. Therefore, even with the structure which simply introduces a cooling wind from one cooling fan to plural cooling targets like in the conventional technique as described above, a part of the cooling wind which includes ozone (or a predetermined gas) mixed by cooling the process unit may be mixed in other parts of the cooling wind which are guided to other portions which do not generate any gas, such as the electronic component and the laser unit. If a part of cooling wind polluted by a predetermined gas is mixed with other parts of cooling wind which have not been polluted, the predetermined gas mixed in these other parts of cooling wind may be discharged to the outside of the apparatus without being treated by a filter or the like provided for the predetermined gas.

SUMMARY OF THE INVENTION

The present invention has been made to solve the problems described above, and has an object of providing an image forming apparatus capable of reducing the number of cooling fans placed and of preventing air polluted inside the apparatus from being exhausted out of the apparatus.

According to the present invention, in order to solve the above problems, an image forming apparatus is constructed in a structure comprising: a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including a first wind guide path that guides one of the branched cooling winds to a first cooling target at which a predetermined gas is mixed into the one of the branched cooling winds, and exhausts the one of the branched cooling winds, and a second wind guide path that guides another one of the branched cooling winds to a second cooling target at which the predetermined gas is not mixed into the another one of the branched cooling winds, and exhausts the another one of the branched cooling winds.

DESCRIPTION OF THE EMBODIMENTS

Embodiments of the present invention will now be described below with reference to the drawings.

First Embodiment

Figure 1:
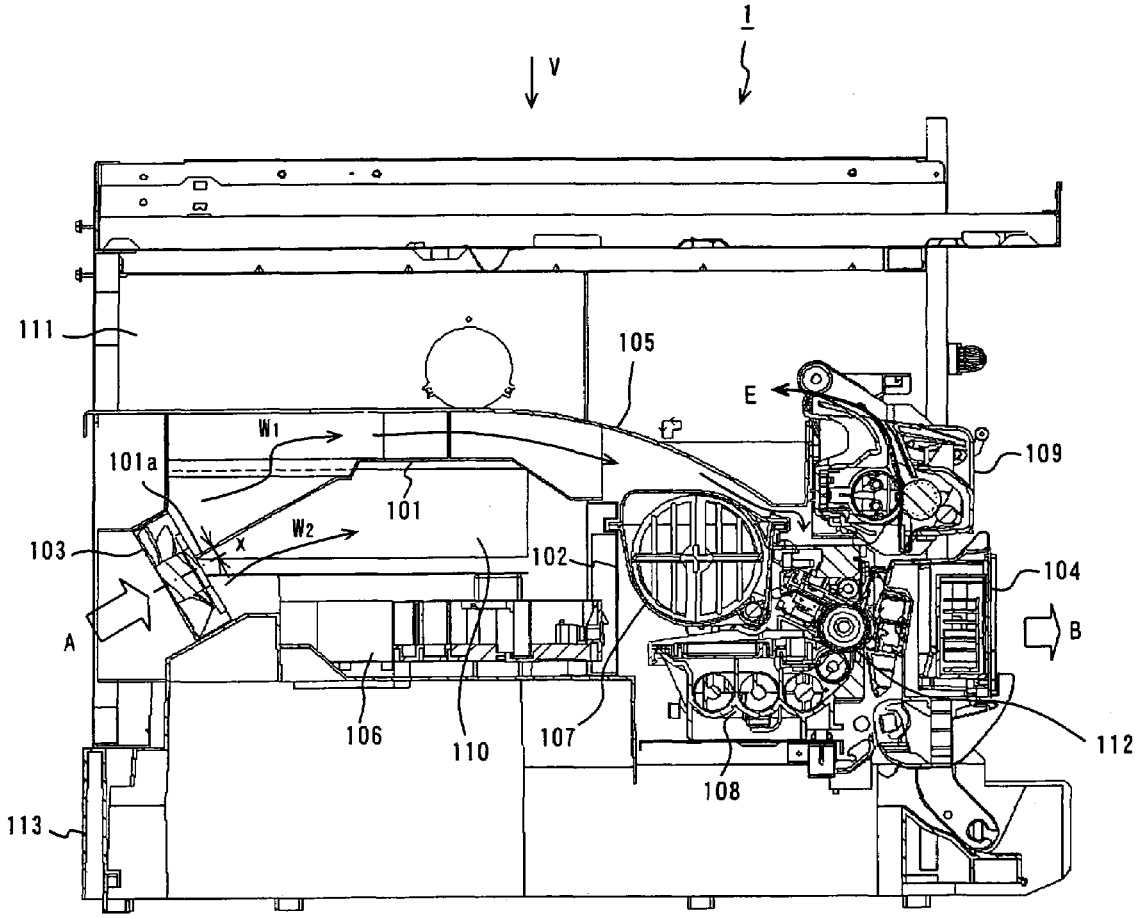
FIG. 1 is a longitudinal cross-sectional view to explain an image forming apparatus according to the first embodiment of the present invention.

FIG. 1 is a longitudinal cross-sectional view (a cross-sectional view observed in the direction H in FIG. 2 described later) to explain an image forming apparatus according to the first embodiment of the present invention. The image forming apparatus according to the present embodiment is constituted, for example, by a printer.

The image forming apparatus 1 according to the present embodiment is constructed in a structure including a branch section 101*a*, a wind division plate 102, a cooling fan 103, an exhaust fan 104, a sheet-discharge tray 105, a laser unit 106, a toner cartridge 107, a process unit 108, a fixing section 109, a power supply section 110, a rear frame 111, and a base frame 113.

The laser unit 106 scans a photosensitive surface of a photosensitive drum 112 in the process unit 108, with a laser beam, based on image data to be formed on a sheet.

The process unit 108 develops, with toner, an electrostatic latent image formed on the photosensitive surface of the photosensitive drum 112 by a laser beam of the laser unit 106, and transfers a toner image obtained to a sheet.

The image forming section of the image forming apparatus according to the present embodiment includes at least the process unit 108 described above.

The sheet on which the toner image has been transferred by the process unit 108 is pressed with the toner image being heated by the fixing section 109. Thus, the toner image is fixed to the sheet.

The sheet to which the toner image has been fixed as described above is conveyed in the direction E and discharged onto a sheet tray surface of a sheet-discharge tray 105.

The toner cartridge 107 functions to supply toner, and the power supply section 110 functions to supply the image forming apparatus with electric power. The rear frame 111 and the base frame 113 form part of a housing of the image forming apparatus 1.

The cooling fan 103 intakes air from outside of the apparatus (see the arrow A), and functions to generate a cooling wind for cooling the toner cartridge 107, process unit 108, and laser unit 106 which generate heat as these components performs an image forming processing on a sheet, as described above.

The branch section 101*a* is formed at an end portion of a plate-like member 101 in the upstream side in the direction in which the cooling wind flows from the cooling fan 103, and functions to branch the cooling wind from the cooling fan 103 into cooling winds W1 and W2. In this case, the cooling wind is divided vertically.

The wind division plate 102 is provided to be continuous to the other end of the plate-like member 101 in the downstream side in the direction in which the cooling wind W1 flows. The wind division plate 102 is arranged between an area including the toner cartridge 107 and the process unit 108 and another area including the laser unit 106, so as to separate the toner cartridge 107 and the process unit 108 from the laser unit 106.

Wind guide paths which respectively guide the cooling winds branched by the branch section 101*a* to cooling targets are constituted by the plate-like member 101 and by wall surfaces of plate-like members forming part of the wind division plate 102 and the sheet-discharge tray 105.

More specifically, the wind guide paths are first and second wind guide paths. The first wind guide path is constituted by the lower face of a plate-like member forming part of the sheet-discharge tray 105 (e.g., an outer wall of a predetermined unit constituting the image forming apparatus), the upper surface of the plate-like member 101, the right side surface of the wind division plate 102 in FIG. 1, the base frame 113, and the like. The second wind guide path is constituted by the lower surface of the plate-like member 101, the left side surface of the wind division plate 102 in FIG. 1, the rear frame 111, the base frame 113, and the like.

Figure 2:
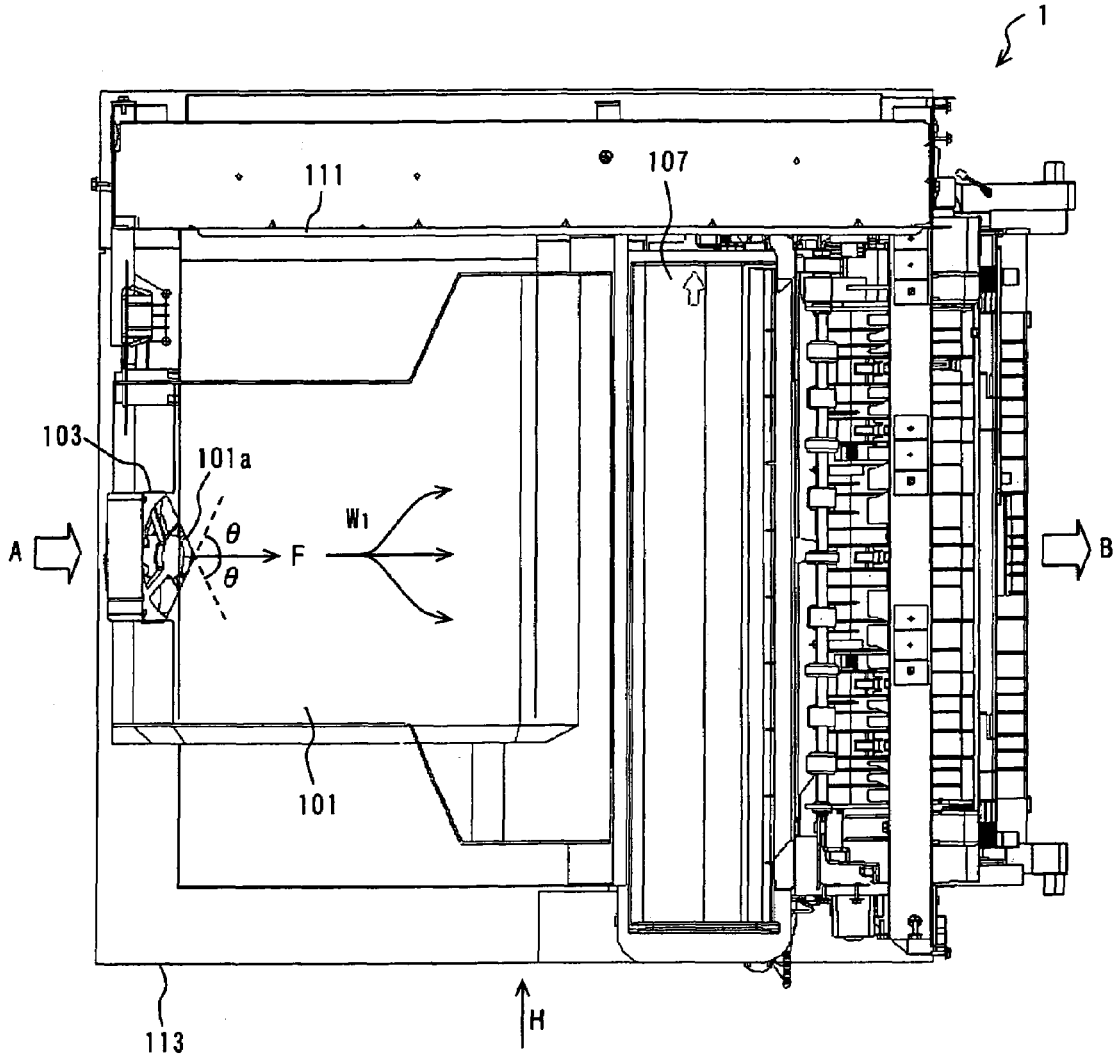
FIG. 2 is a view of the shape of a first wind guide path, observed from the direction V.
Figure 3:
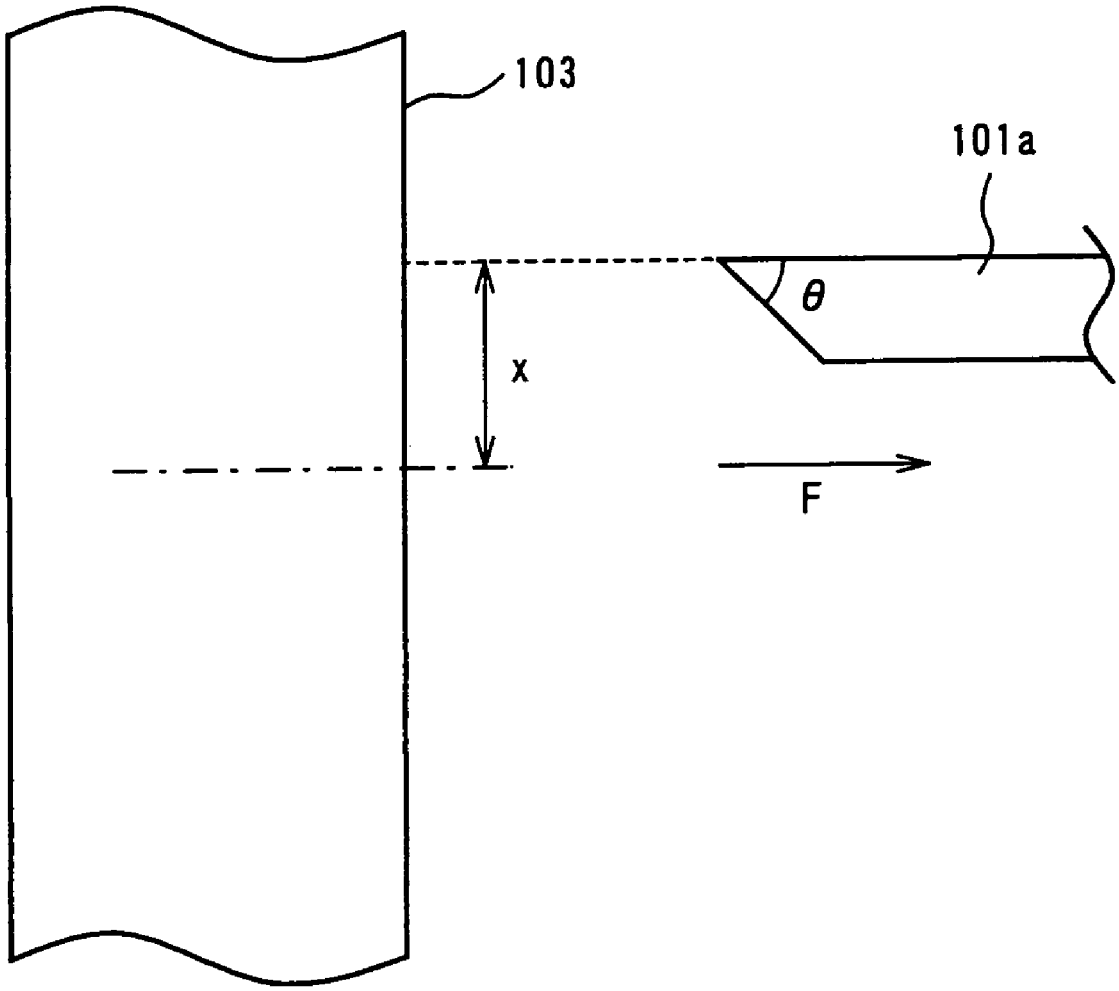
FIG. 3 is a detail view of the shape of a branch section 101*a*, observed from the direction H in FIG. 2.
Figure 4:
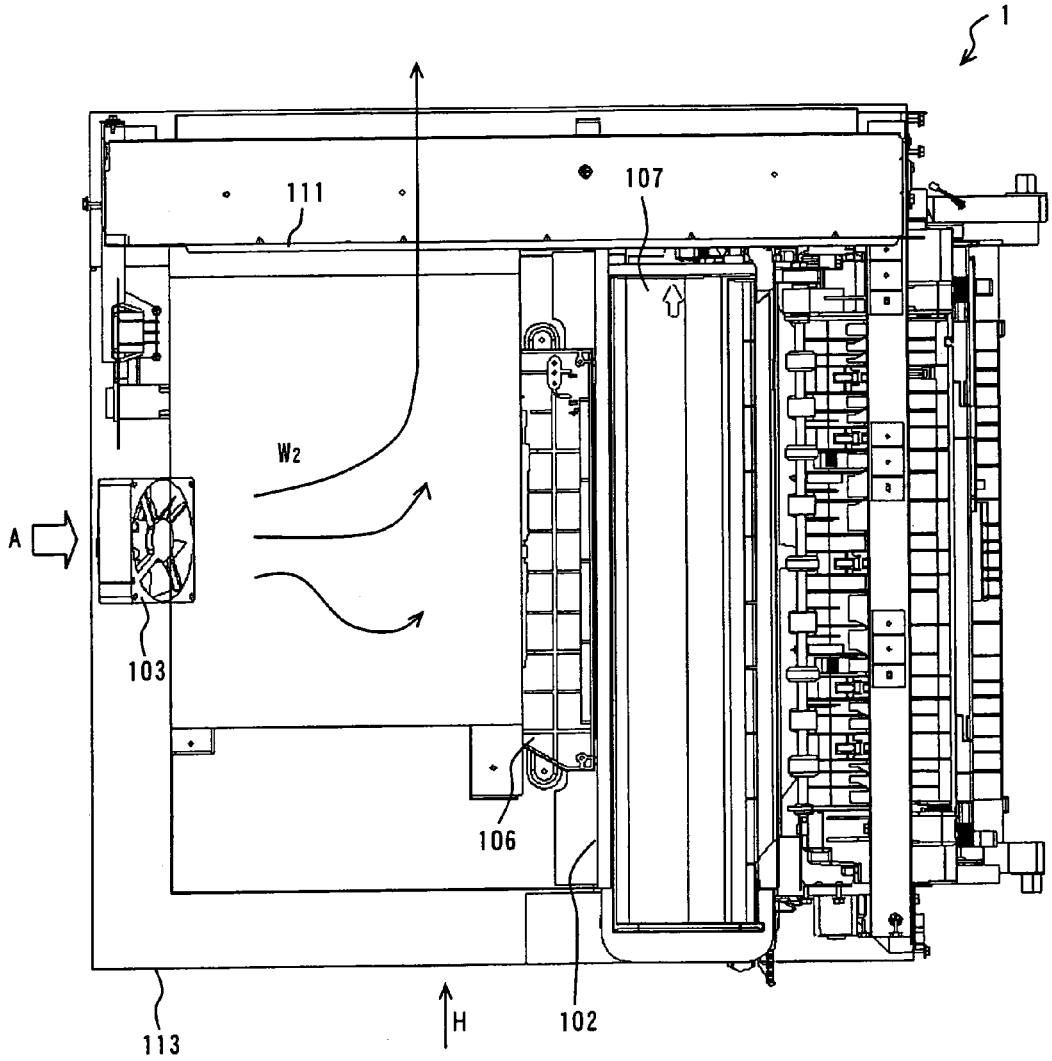
FIG. 4 is a view of the shape of the second wind guide path, observed from the direction V in FIG. 1.

FIG. 2 is a view showing the shape of the first wind guide path, observed in the direction V in FIG. 1. FIG. 3 is a detail view showing the shape of the branch section 101*a*, observed from the direction H in FIG. 2. FIG. 4 is a view showing the shape of the second wind guide path, observed from the direction V in FIG. 1.

The cooling wind W1 flowing through the first wind guide path functions to cool the toner cartridge 107, the process unit 108, and the like. The process unit 108 generates ozone (a predetermined gas) as this unit operates. Therefore, ozone is mixed in the cooling wind W1 which passes near the process unit 108.

The exhaust fan 104 has an ozone filter and removes ozone mixed in the cooling wind W1 which has passed through the first wind guide path. At the same time, the exhaust fan 104 discharges the cooling wind W1 from which ozone has been removed to the outside of the apparatus (see the arrow B).

On the other side, the cooling wind W2 flowing through the second wind guide path functions to cool cooling targets such as the laser unit 106 and power supply section 110 which do not cause air pollution (or mixture of a predetermined gas). After cooling the predetermined cooling targets, the cooling wind W2 is naturally discharged through an exhaust port not shown but provided in the rear frame 111.

Thus, the cooling targets to be cooled by the cooling winds W1 and W2 are the power supply section which supplies the image forming apparatus with electric power, and the image forming section which forms images on sheets.

As has been described above, the present embodiment is arranged such that a cooling wind from one cooling fan is branched and guided to plural cooling targets to be cooled. Therefore, the number of fans mounted can be reduced preferably from the viewpoints of cost reduction and space saving.

In addition, a wind guide path which is polluted by a predetermined gas such as ozone is perfectly separated from another wind guide path which is not polluted. Partitioning is thus carried out so that cooling winds are not exchanged between the wind guide paths. As a result, the cooling wind W2 flowing through the second wind guide path is not polluted by a predetermined gas mixed in the cooling wind W1 flowing through the first wind guide path. Accordingly, it is possible to prevent a cooling wind including the predetermined gas such as ozone from being exhausted to the outside without being filtered.

Next, the shape of the branch section 101*a* will be described in detail. The branch section 101*a* is constructed at an end portion of the plate-like member 101. At least such a part of the branch section 101*a* that is close to the cooling fan 103 of the branch section 101*a* is adjusted to be inclined with an inclination angle θ to the wind direction F of the cooling wind from the cooling fan 103 (see FIGS. 2 and 3). Thus, since the shape of the end surface of the branch section 101*a* is inclined to the wind direction of the cooling wind, it is possible to reduce noise generated when the cooling wind blows against the end surface of the branch section 101*a*. In addition, it is possible to restrict turbulence of the air flow.

Also, the branch section 101*a* is provided near the outer side of the fan in the radial direction, at the wind flowing part (fan part) of the cooling fan 103. Specifically, in this case, the branch section 101*a* is provided at a position offset by a distance x from the rotation center of the fan. By thus providing the branch section 110*a* near an outer peripheral position of the fan, an air volume can be efficiently gained by the one wind guide path that has a smaller area to take in a cooling wind than the other wind guide path. This layout is also effective for a case that any of branched cooling winds has to flow through a narrow space.

In addition, the installation position (x in FIG. 3) and the shape of the branch section 101*a* are set such that the air volume of the cooling wind W1 supplied per unit time by the cooling fan 103 to the first wind guide path is not greater than the wind volume which can be exhausted per unit time by the exhaust fan 104. In this structure, the polluted cooling wind W1 of a volume beyond the exhaust capability of the exhaust fan 104 is supplied, so that the air pressure inside the first wind guide path becomes greater than the air pressure inside the second wind guide path subjected to natural exhaustion. Accordingly, there does not occur a problem that the polluted cooling wind W1 cannot stay in the first wind guide path and enter into the second wind guide path.

In addition, a part of the wind guide paths is constituted by wall surfaces of components constituting predetermined units, such as sheet-discharge tray 105, that constitute the image forming apparatus 1 (i.e., the number of components to constitute the wind guide paths is reduced as much as possible). This contributes to reduction in the number of components in the whole apparatus.

Also according to the present embodiment, the cooling fan 103 is placed at the center position in a direction perpendicular to the wind feed direction of the fan. Therefore, it is possible to feed the laser unit 106, toner cartridge 107 and power supply section 110 with a cooling wind efficiently and evenly without changing the direction of the cooling wind from the cooling fan 103.

Second Embodiment

Next, the second embodiment of the present invention will be described. The present embodiment is a modification of the first embodiment described above. The position of the cooling fan and the shapes of the wind guide paths are different from those of the first embodiment. In the following, those portions that are identical to the portions described already in the first embodiment will be denoted at the identical reference symbols. A description thereof will be omitted herefrom.

Figure 5:
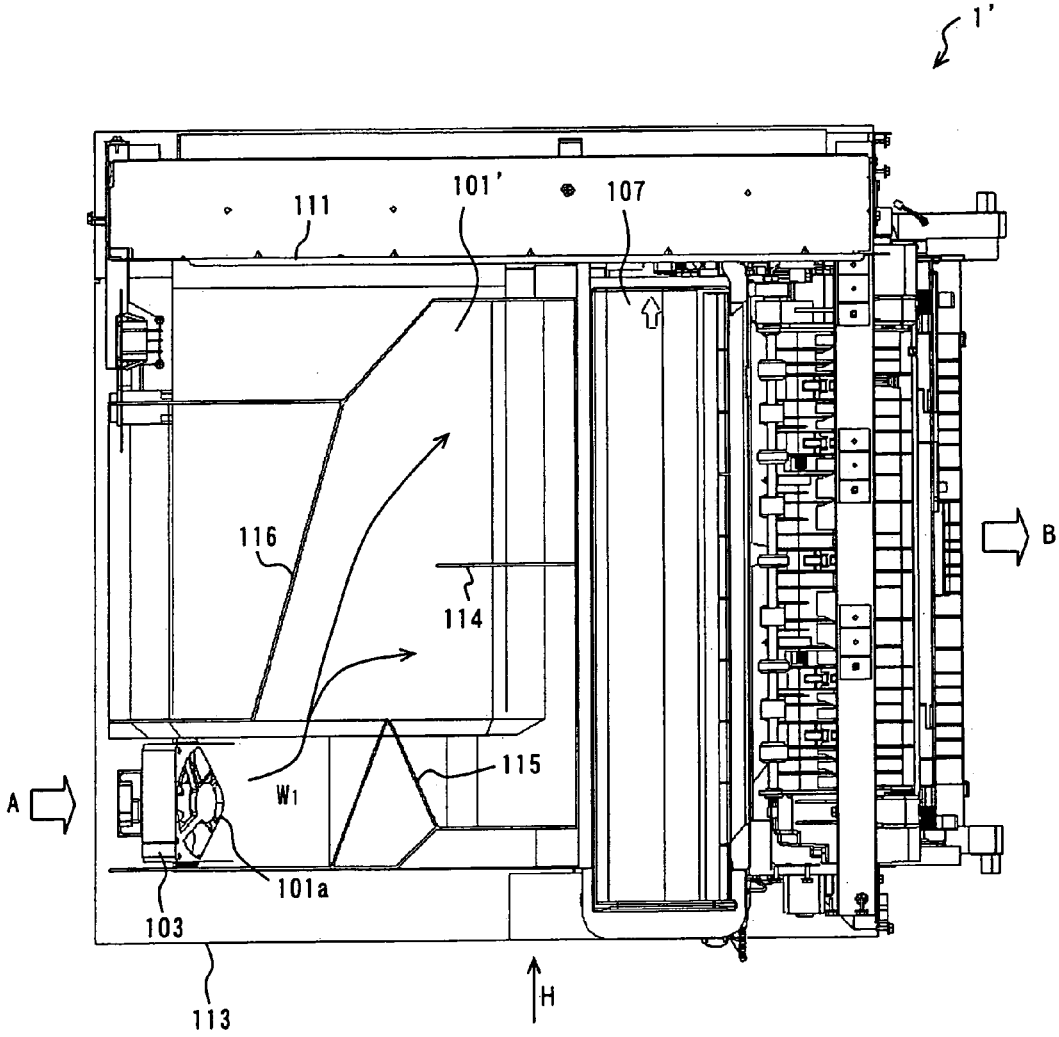
FIG. 5 is a view of the shape of a first wind guide path in an image forming apparatus 1' according to the second embodiment of the present invention, observed from the direction V in FIG. 1.
Figure 6:
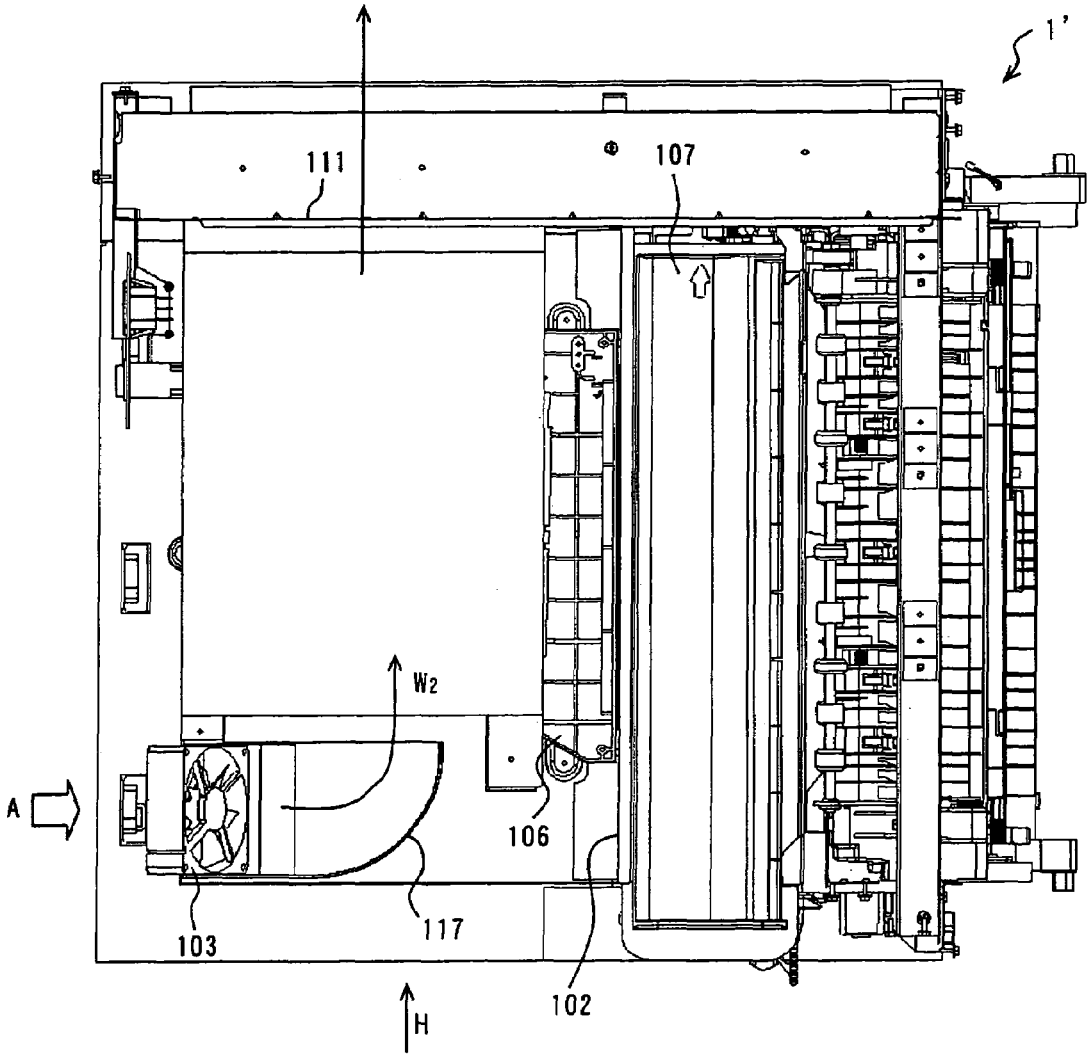
FIG. 6 is a view of the shape of a second wind guide path in the image forming apparatus 1' according to the second embodiment, observed from the direction V in FIG. 1.

FIG. 5 is a view showing a first wind guide path in an image forming apparatus 1' according to the present embodiment, observed in the direction V in FIG. 1. FIG. 6 is a view showing a second wind guide path in the image forming apparatus 1' according to the present embodiment, observed in the direction V in FIG. 1. As shown in these figures, a cooling fan 103 is placed at a position deviated to a corner portion of the apparatus, in the present embodiment.

The first wind guide path in the present embodiment is constituted by the lower surface of a plate-like member forming part of a sheet-discharge tray 105 (e.g., an outer wall of a predetermined unit forming part of the image forming apparatus), the upper surface of a plate-like member 101', a right side surface of the wind division plate 102 in FIG. 1, a base frame 113, an air volume control plate 114, guides 115 and 116, and the like. The second wind guide path is constituted by the lower surface of the plate-like member 101', a left side surface of a wind division plate 102 in FIG. 1, a rear frame 111, the base frame 113, a wind direction control plate 117, and the like.

The direction of the cooling wind W1 is changed to a direction toward the center of the apparatus by the guides 115 and 116, and is further guided in a direction toward the toner cartridge 107, to cool this toner cartridge 107. At this time, if variants occur in the cooling efficiency in directions to the front and rear of the apparatus (e.g., the vertical direction in FIG. 5), an air volume control plate 114 is provided. The position and length of this plate are optimized by fluid analysis or the like. In this manner, the wind flow and the cooling efficiency can be optimized.

The cooling wind W2 is provided with a wind direction control plate 117 formed by casting from the base frame 113, in the outlet side of the cooling fan 103. The direction in which the cooling wind w2 flows is changed by the wind direction control plate 117 to such a direction in which the cooling wind W2 flows straight from the front side of the apparatus to the rear side thereof (in the direction H), to cool the power supply section 110 and the laser unit 106.

Third Embodiment

Next, the third embodiment of the present invention will be described. The present embodiment is a modification of the first embodiment described above. The position of the cooling fan and the shapes of the wind guide paths are different from those of the first embodiment. In the following, those portions that are identical to the portions described already in the first embodiment will be denoted at the identical reference symbols. A description thereof will be omitted herefrom.

Figure 7:
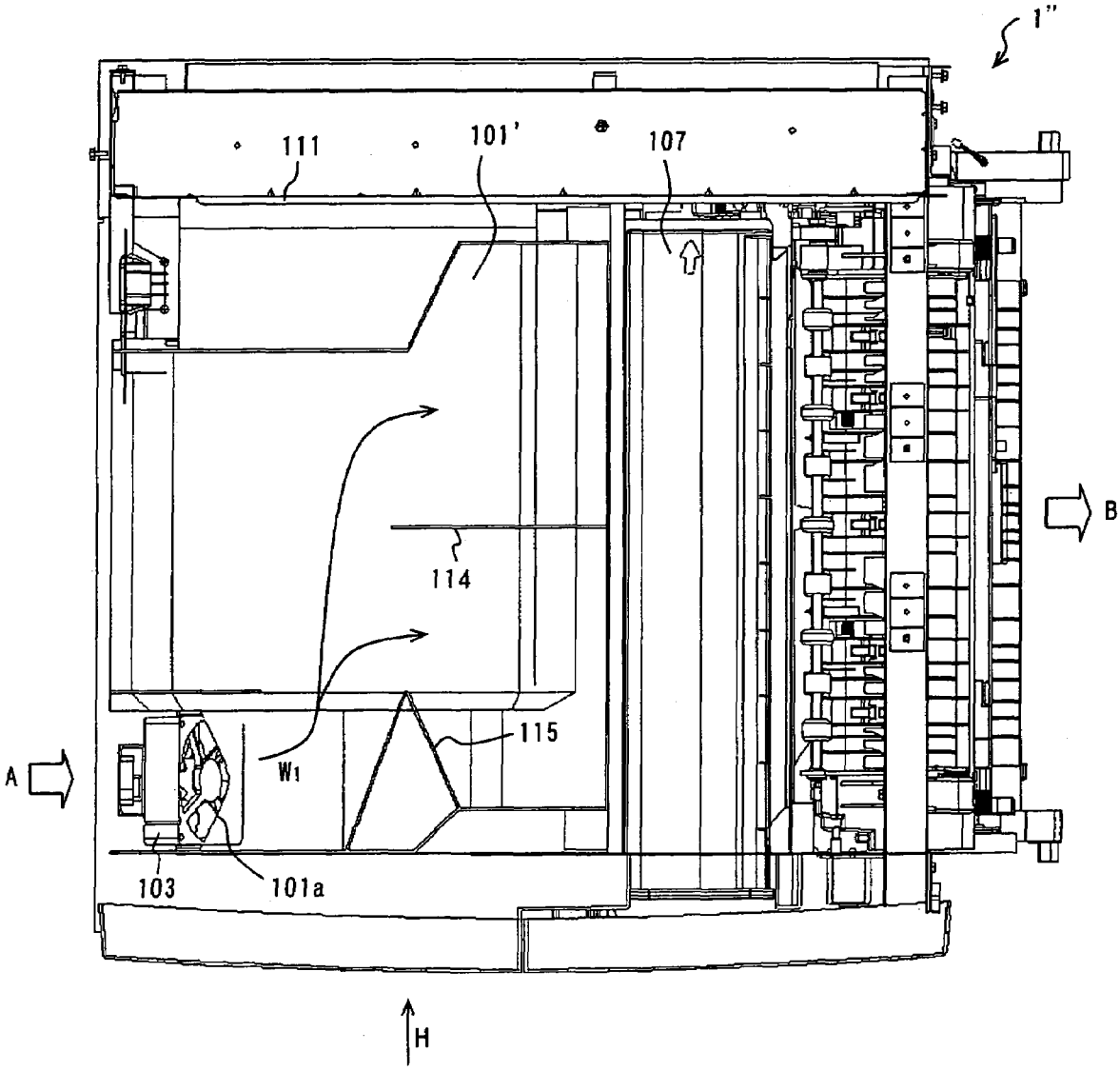
FIG. 7 is a view of the shape of a first wind guide path in an image forming apparatus 1" according to the third embodiment of the present invention, observed from the direction V in FIG. 1.

FIG. 7 is a view showing a first wind guide. path in an image forming apparatus 1" according to the present embodiment, observed in the direction V in FIG. 1. As shown in this figure, a cooling fan 103 is placed at a position deviated to a corner portion of the apparatus, in the present embodiment.

The first wind guide path in the present embodiment is constituted by the lower surface of a plate-like member forming part of a sheet-discharge tray 105 (e.g., an outer wall of a predetermined unit forming part of the image forming apparatus), the upper surface of a plate-like member 101', a right side surface of a wind division plate 102 in FIG. 1, a base frame 113, an air volume control plate 114, a guide 115, and the like.

The direction of the cooling wind W1 is changed to a direction toward the center of the apparatus by the guide 115, and is further guided in a direction toward the toner cartridge 107, to cool this toner cartridge 107. Note that the present embodiment differs from the second embodiment in that the guide 116 is not provided and that the air volume control plate 114 is longer than that of the second embodiment.

In each of the above embodiments, an efficient cooling process is carried out inside the apparatus. Therefore, the ratio between cooling winds branched by a branch section may be set such that the cooling wind guided to a cooling target having greater heat capacity has a greater air volume.

Each of the above embodiments shows an example in which a cooling wind from a cooling fan is branched into two winds. The present invention is not limited to these embodiments but the cooling wind from the cooling fan may be branched into any number of winds, corresponding to the number of cooling targets.

Also in each of the above embodiments, how cooling winds W1 and W2 are guided to cooling targets (i.e., the shapes of wind guide paths) may be determined by appropriately combining shapes of the wind guide paths of the embodiments, corresponding to the layout of components in the apparatus.

Also each of the above embodiments exemplifies a case that the image forming apparatus according to the present invention is a printer. The present invention is not limited to these embodiments but the same effects and advantages can be achieved even in another case that the image forming apparatus is constituted by a copy machine, facsimile, MFP (Multi-Function Peripheral), or the like.

The present invention has been described in details above with reference to specific embodiments. However, various modifications and improvements would readily occur to the persons in the art without deviating from the spirit and scope of the present invention.

As has been described above, according to the present invention, it is possible to provide an image forming apparatus capable of reducing the number of cooling fans placed, and capable of preventing air polluted in the apparatus from being discharged to the outside.

What is claimed is:

1. An image forming apparatus, comprising:

a branch section that branches a cooling wind from a cooling fan into branched cooling winds;

a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds; and an exhaust fan which exhausts a gas flowing through the first wind guide path to the outside of the apparatus, wherein the branch section is set such that a wind volume supplied per unit time to the first wind guide path by the cooling fan is set to be equal to or smaller than a wind volume which can be exhausted per unit time by the exhaust fan.

2. An image forming apparatus, comprising:

a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds, wherein at least a part of wall surfaces of a flow path of the wind guide path through which a gas flows is constituted by a wall surface of a predetermined unit constituting the image forming apparatus.

3. An image forming apparatus, comprising:

a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds, wherein the branch section is constituted by a plate-like member, and at least a part of an end portion of the branch section in a side thereof close to the cooling fan is set to be inclined to a wind direction of the cooling wind from the cooling fan.

4. An image forming apparatus, comprising:

a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds, wherein the branch section is constituted by a plate-like member and is positioned near the outer side of the fan in a radial direction of the fan at a wind feed portion of the cooling fan.

5. An image forming apparatus, comprising:

a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds, wherein the branch section is set such that such one of the branched cooling winds that is guided to a cooling target having greater heat capacity has a greater wind volume.

6. An image forming apparatus, comprising:

a branch section that branches a cooling wind from a cooling fan into branched cooling winds; and a wind guide path that guides the branched cooling winds branched by the branch section to cooling targets to be cooled, respectively, and exhausts the branched cooling winds, the wind guide path including:

a first wind guide path that guides one of the branched cooling winds to a first cooling target at which a predetermined gas is mixed into the one of the branched cooling winds, and exhausts the one of the branched cooling winds; and a second wind guide path that guides another one of the branched cooling winds to a second cooling target at which the predetermined gas is not mixed into the another one of the branched cooling winds and exhausts the another one of the branched cooling winds, wherein the cooling targets include at least one of a power supply section that supplies the image forming apparatus with electric power and an image forming section that forms an image on a sheet.

* * * * *